US008293443B2

(12) United States Patent
Carter, Jr. et al.

(10) Patent No.: US 8,293,443 B2
(45) **Date of Patent: *Oct. 23, 2012**

(54) BLACK TONERS CONTAINING INFRARED TRANSMISSIVE AND REFLECTING COLORANTS

(75) Inventors: Albert Mann Carter, Jr., Richmond, KY (US); Gary Allen Denton, Lexington, KY (US); Joseph Edward Johnson, Lexington, KY (US); John Melvin Olson, Boulder, CO (US); Trent Peter, Johnstown, CO (US); Cary Patterson Ravitz, Lexington, KY (US); Tao Yu, Louisville, CO (US)

(73) Assignee: Lexmark International, Inc., Lexington, KY (US)

( * ) Notice: Subject to any disclaimer, the term of this patent is extended or adjusted under 35 U.S.C. 154(b) by 1317 days.

This patent is subject to a terminal disclaimer.

(21) Appl. No.: 11/871,245

(22) Filed: Oct. 12, 2007

(65) Prior Publication Data

US 2009/0098477 A1 Apr. 16, 2009

(51) Int. Cl.
*G03G 9/09* (2006.01)

(52) U.S. Cl. ..... 430/108.9; 430/108.1; 430/108.2; 430/108.21; 430/108.23; 430/45.1; 399/159

(58) Field of Classification Search ..... 430/108.1, 430/108.2, 108.21, 108.23, 108.9, 45.1; 399/159
See application file for complete search history.

(56) References Cited

U.S. PATENT DOCUMENTS

| | | | | |
|---|---|---|---|---|
| 4,424,292 | A | | 1/1984 | Ravinovitch et al. |
| 4,623,602 | A | * | 11/1986 | Bakker et al. ..... 430/110.2 |
| 5,028,507 | A | | 7/1991 | Kidnie |
| 5,103,260 | A | | 4/1992 | Tompkins et al. |
| 5,262,264 | A | | 11/1993 | Shimizu et al. |
| 5,273,853 | A | * | 12/1993 | Urano et al. ..... 430/108.21 |
| 5,512,986 | A | | 4/1996 | Toyomura et al. |
| 5,540,998 | A | | 7/1996 | Yamada et al. |
| 6,009,285 | A | | 12/1999 | Barry et al. |
| 6,120,959 | A | | 9/2000 | Sugizaki et al. |
| 6,123,417 | A | | 9/2000 | Bard et al. |
| 6,130,017 | A | | 10/2000 | Hayashi et al. |
| 6,154,238 | A | | 11/2000 | Cook et al. |
| 6,161,921 | A | | 12/2000 | Bard et al. |
| 6,254,221 | B1 | | 7/2001 | Bard et al. |
| 6,521,038 | B2 | | 2/2003 | Yanagimoto et al. |
| 6,531,254 | B1 | | 3/2003 | Bedells et al. |

(Continued)

FOREIGN PATENT DOCUMENTS

JP 06-236070 * 8/1994

(Continued)

OTHER PUBLICATIONS

Translation of JP 06-236070 published Aug. 1994.*

(Continued)

*Primary Examiner* — Peter Vajda

(57) ABSTRACT

A toner formulation is disclosed comprising a binder and an IR absorbing black pigment at a concentration of 0.25-2.0% by weight, including one or more infrared transmissive pigments, wherein the infrared transmissive pigments are configured to provide a black color. Such toner formulation may provide a response to a toner patch sensor to indicate a mass per unit area of 0.1-1.5 mg/cm$^2$ or a reflectance relative to a substrate to define a reflectance ratio that varies relative to L* values for the toner over the range L*=0-50 or a bulk reflectivity of greater than 6.0% for a portion of the wavelength range of 850-2000 nanometers.

18 Claims, 9 Drawing Sheets

U.S. PATENT DOCUMENTS

| | | | | |
|---|---|---|---|---|
| 6,531,256 | B1 | 3/2003 | Bedells et al. | |
| 6,559,590 | B1 | 5/2003 | Mori et al. | |
| 6,560,418 | B2 | 5/2003 | Campbell et al. | |
| 6,628,398 | B1 | 9/2003 | Denton et al. | |
| 6,628,426 | B2 | 9/2003 | Denton et al. | |
| 6,731,889 | B2 | 5/2004 | Nakayama | |
| 6,797,218 | B1 | 9/2004 | Bickerstaff | |
| 6,913,864 | B2 | 7/2005 | Shimizu et al. | |
| 6,953,504 | B2 | 10/2005 | Nakata et al. | |
| 6,957,024 | B2 | 10/2005 | Shinkawa et al. | |
| 6,989,056 | B2 | 1/2006 | Babler | |
| 7,006,250 | B2 | 2/2006 | Denton et al. | |
| 7,077,898 | B2 | 7/2006 | Babler | |
| 7,171,134 | B2 | 1/2007 | Denton et al. | |
| 2001/0046634 | A1 * | 11/2001 | Tomita et al. | 430/108.1 |
| 2003/0215249 | A1 * | 11/2003 | Shinkawa et al. | 399/38 |
| 2003/0232999 | A1 * | 12/2003 | Sasaki et al. | 548/402 |
| 2005/0026066 | A1 * | 2/2005 | Tanaka et al. | 430/137.17 |
| 2007/0196753 | A1 * | 8/2007 | Carter et al. | 430/104 |

FOREIGN PATENT DOCUMENTS

| | | | |
|---|---|---|---|
| JP | 2005-195693 | * | 7/2005 |

OTHER PUBLICATIONS

Product Data Sheet for Chromofine Black A-1103 obtained from webiste: http://www.daicolor.co.jp/users/org11/web-e/use/ink-E/A1103.pdf and published 2010.*

CAS registry file showing synonyms for C.I. Pigment Red 122.*

Translation of JP 2005-195693 published Jul. 2005.*

* cited by examiner

BLACK TONERS CONTAINING INFRARED TRANSMISSIVE AND REFLECTING COLORANTS

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to combinations of toner colorants that may be used for monitoring toner layer thickness in electrophotographic systems. More specifically, toner may be formulated to include infrared transmissive and/or infrared reflecting colorants that may be utilized to optimize the performance of a toner patch sensor. In particular, the infrared transmissive and/or infrared reflecting colorants may be specifically employed to provide black toners with improved toner patch sensitivity which black toner may optionally incorporate carbon black.

2. Description of the Related Art

Electrostatically printed color images may be produced by depositing toners of various colors onto a recording media, such as a sheet of paper. A wide palette of printed colors may be generated by printing yellow, cyan, magenta and black toners in various proportions and combinations. Each individual color of the producible palette may require a specific proportion and combination of toners. If the particular proportions of toner for a selected color cannot be repeatedly deposited on the printed media then the printed color may not be consistent and vary in hue, chroma, and/or lightness from attempt to attempt of printing. The proportion of each toner color to be deposited is controlled by the thickness of the toner layer of a given color and the halftone area coverage. Therefore, controlling the printed colors, and ensuring reproducibility of the printed colors, may be achieved by controlling the toner layer thickness to ensure consistent color reproduction.

Toner patch sensors have therefore been used in printers and copiers to monitor the toner density of unfused images and provide a method of controlling the print darkness. In color printers and copiers, the toner patch sensors may be used to maintain the color balance and in some cases to modify the gamma correction or halftone linearization as the electrophotographic process changes with the environment and aging effects. However, monitoring the amount of black toner on black intermediate belts or black paper transport belts is problematic due to the low optical contrast between the black toner and the underlying surface.

SUMMARY OF THE INVENTION

In a first exemplary embodiment, the present disclosure relates to a toner formulation which may be used in an electrophotgraphic printing device or cartridge. The formulation may contain a binder and an infrared absorbing black pigment such as carbon black at a concentration of 0.25 to 2.0% by weight and one or more infrared transmissive pigments wherein the infrared transmissive pigments are configured to provide a black color.

In a second exemplary embodiment, the present disclosure relates to toner formulation comprising a binder and an IR absorbing black pigment at a concentration of 0.25-2.0% by weight, including one or more infrared transmissive pigments at a level of less than or equal to 15.0% by weight. The infrared transmissive pigments are configured to provide a black color and respond to a toner patch sensor to indicate a mass per unit area of unfused toner of 0.1-1.5 mg/cm$^2$.

In a third exemplary embodiment, the present disclosure relates to a method for calibrating an image forming device using a toner patch sensor and a toner formulation comprising depositing a plurality of toner patches onto a control surface, wherein the toner patches include a first toner patch, including a first toner, a second toner patch including the first toner deposited over a second toner and a third toner patch including the second toner. The first toner may comprise a binder and an IR absorbing black pigment at a concentration of 0.25-2.0% by weight, including one or more infrared transmissive pigments, wherein the infrared transmissive pigments are configured to provide a black color. This may then be followed by measuring signals indicative of reflectivity of the plurality of toner patches and the reflectivity of the control surface by emitting light of a given wavelength in the infrared spectrum and detecting the amount of incident light reflected from the plurality of toner patches and said control surface. The first toner patch may exhibit a first reflectivity $R_1$ at the given wavelength, the second toner patch exhibiting a second reflectivity $R_2$ at the given wavelength, the third toner patch exhibiting a third reflectivity $R_3$ at the given wavelength. The control surface exhibits a fourth reflectivity $R_{control}$ at the given wavelength, wherein $R_{control} \neq R_3$; followed by adjusting a printer operating parameter based upon such measurements.

BRIEF DESCRIPTION OF THE DRAWINGS

The above-mentioned and other features and advantage of this invention, and the manner of attaining them, will become more apparent and the invention will be better understood by reference to the following description of embodiments of the invention taken in conjunction with the accompanying drawings, wherein.

DETAILED DESCRIPTION

Figure 1:
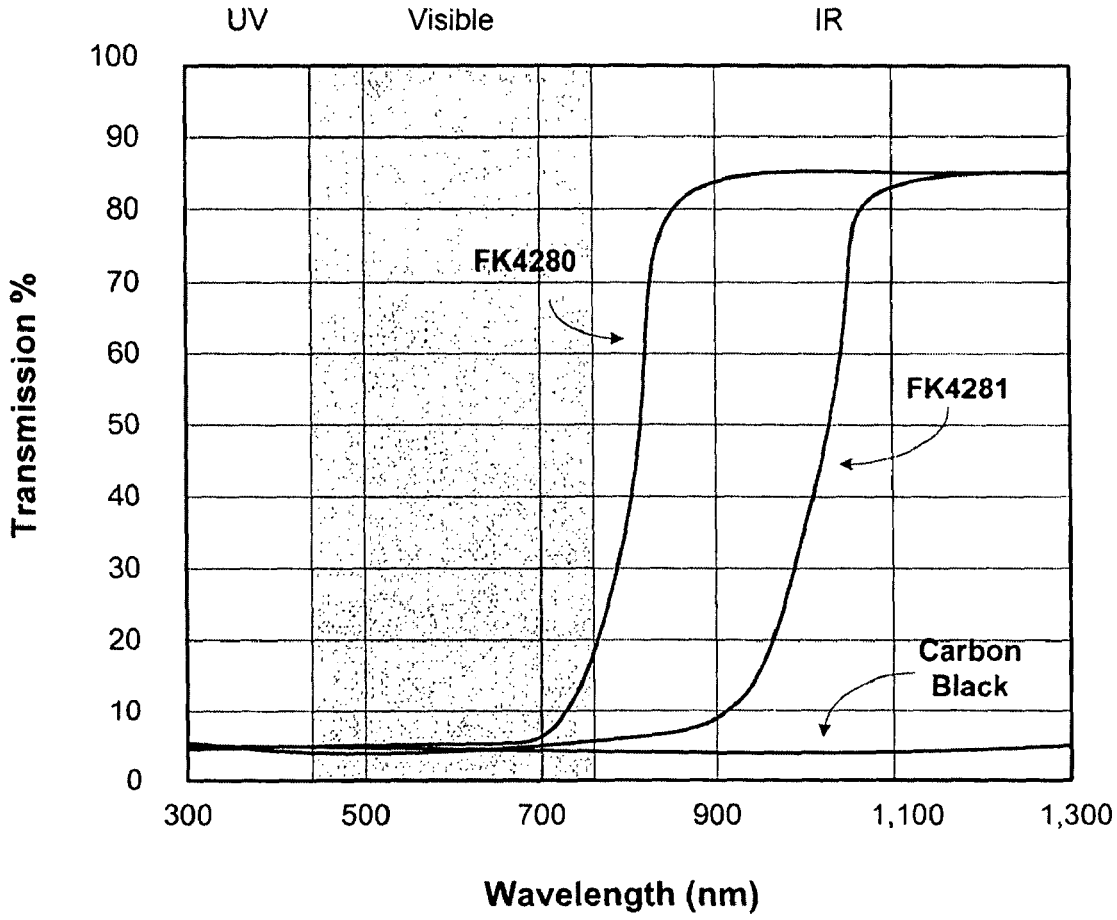
FIG. 1 is a plot of percent transmission versus wavelength for exemplary IR transmissive pigments versus carbon black.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

The present invention generally relates to image forming media (e.g. toner) containing a binder, which may be understood as a polymeric type resin. Such polymeric resin may therefore include, e.g., those polymers that are typically used in toners to provide appropriate fusing characteristics when used in an electrophotographic type printer. For example, the binder may comprise thermoplastic type polymers such as styrene or styrene-acrylate type polymers, polyester polymers, etc. The image forming media herein may therefore include toner and the image forming apparatus may include an electrophotographic device, copier, fax, all-in-one device or multi-functional device. Toner for electrophotographic (e.g. laser) printing may be prepared according to a number of techniques.

According to a first technique, a so-called "conventional toner" may be prepared from a toner resin that may be melt mixed with pigment and other additives. The melt mixed toner formulation may be crushed, pulverized, milled, and classified to provide fine particles of a desired size. Additives may be incorporated onto the toner particle surfaces as an extra particulate additive. According to another technique, "chemically produced toner" may be prepared in which toner particles may be prepared by chemical processes such as aggregation or polymerization rather than being abraded from much larger size materials by physical processes.

The toner herein may also include an IR absorbing black pigment, such as carbon black, wherein the carbon black is present at a level of about 0.25 to about 2.0 percent by weight, including all values and increments therein. For example, the level of carbon black may be 0.30%, 0.40%, 0.50%, 0.60%, wherein the percent (%) indication is again an indication of a percent by weight with respect to the overall toner composition. As described more fully below, this level of carbon black may be strategically selected to contribute to the development of black pigmentation along with the ability for such toner formulation to remain responsive to a toner patch signal (TPS) apparatus. It may therefore be appreciated that in addition to carbon black, IR absorbing black colorants may be provided by materials such as oxidic black pigment, including iron oxide black ($Fe_3O_4$) and spinel black ($Cu(Cr,Fe)_2O_4$). IR absorbing black pigmentation may also depend upon the use of what may be understood as organic black colorants (i.e., carbon-based compounds other than simply carbon black).

The toner herein may also include infrared transmissive pigments, wherein such infrared pigments are configured or combined to provide a black color. In the present invention, the black color toner compositions are prepared so that they may have a specific chroma C* value. More specifically, the toner compositions are prepared so that the chroma C* value is less than or equal to about 15.0 for solids and all halftone shade levels, printed on white paper (e.g. Hammermill® Laser Print Paper) including all values and increments between 0-15.0. Lightness index (L*), hue angle (h) and chroma (C*) are based on the L* a* b* calorimetric system standardized by the Commission International de l'Eclairage (CIE) in 1976, which is defined in JIS Z 8729 in the Japanese Industrial Standards (JIS).

The infrared transmissive pigments may also be understood as reference to a pigment that does not compromise the ability of a toner patch sensor, a specific example of which is noted below, to provide information regarding the amount of unfused toner on a given surface. Such transparency may therefore allow the incident IR light to diffuse to underlying toner layers and reflect, thereby increasing the relative amount of reflected light with relatively thicker toner layers. Overall, this may then produce acceptable toner patch sensor sensitivity at selected target mass, which target mass is also described more fully below. Accordingly, the toner formulations herein provide a black toner with better color control and which may still be responsive to a toner patch sensor. Such improved toner layer thickness control may therefore lead to improved ability to accurately and repeatedly produce colors of an image developed on a recording media, e.g. a printed image. Reference to pigment herein is intended to be inclusive of any composition that may independently provide a given color.

The image forming device herein may include a closed-loop control system to maintain the proportions of image forming media that may be deposited during the image developing process, i.e., during printing. This may eliminate, or at least reduce, color shifts in printed images. In an exemplary control system the toner layer thickness may be determined based on a light signal reflected by a printed test pattern of unfused toner. For example, a light source may be used to illuminate solid and grayscale printed patterns, or patches, of the four toners, i.e., yellow cyan, magenta, and black printed on a control surface. The reflected light signal may then be used to estimate toner layer density or thickness. One exemplary device herein for monitoring toner density or thickness on an unfused image is the toner patch sensor (TPS) as described in U.S. Pat. No. 6,628,398, whose teachings are incorporated by reference. Accordingly, an infrared light signal reflected by a printed toner layer or test pattern may therefore be generally related to the infrared reflectivity of the toner pigment and to the printed density or toner layer thickness. The TPS may therefore utilize a test patch in combination with a photodiode which may be configured to provide three different scenarios: (1) direct illumination with indirect detection; (2) indirect illumination and detection; and (3) diffuse illumination with direct detection. Relatively accurate density control may therefore be achieved that is substantially independent of a belt surface roughness.

Accordingly, image forming media (e.g., toner) to be measured for density or thickness may be placed on a control surface that may include a transport or transfer belt. The toner patches, i.e., the solid and grayscale toner test patterns, may be printed on the control surface and the control surface may be impinged with light from an infrared light source. At least a portion of the infrared light may be reflected by the toner patches and collected by an infrared detector. The toner layer density and/or thickness may be determined from the reflected signal strength of the toner patches, e.g., by comparison to the reflected signal strength from the test surface itself and/or in comparison to the reflected signal strength of one or more grayscale toner test patterns. Toner layer density as understood herein is reference to a given mass (e.g. grams) of toner per unit area (e.g. $cm^2$). The operating conditions of the printer may then be adjusted according to the detected toner layer density and/or thickness in order to provide the necessary proportions of toner to achieve a desired color.

It may be therefore appreciated that a conventional black IR absorbing colorant, e.g. carbon black, will generally absorb light in the infrared range of the spectrum, which may therefore produce a relatively weak reflected infrared signal for the TPS. The weak reflected infrared signal may then make it relatively difficult to reliably determine a toner layer thickness of a black toner in a system utilizing infrared reflectivity. More specifically, as the toner patch sensors emit and detect light at about 750 nm-1000 nm, and more particularly, 900 nm-1000 nm, the relatively strong absorption of light by the carbon black at such wavelengths can make toner particles containing carbon black relatively opaque and the toner patch sensor reflection signal may therefore indicate a zero slope (no sensitivity) after more than one monolayer of toner is laid down. This may be particularly problematic in those situations where the desired target mass/unit area (M/A) is 1-3 toner monolayers.

The infrared transmissive black colorants herein, that may be used along with the infrared absorbing black pigments (e.g. carbon black) noted above, may therefore first individually include those pigments known as LUMOGEN® Black FK4280 or FK4281 available from BASF, which rely in part upon a perylene type base structure, as illustrated below:

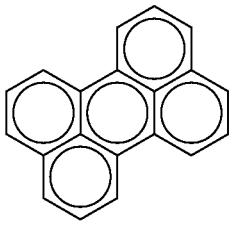

It may therefore be appreciated that the above referenced base perylene structure may be functionalized to include other types of groups, including alkyl groups, carbonyls, imide functionality including imide functionality that contains alkyl and aromatic functionality, etc. The LUMOGEN Black FK4280 is believed to include a perylene isoindolene structure as follows:

I

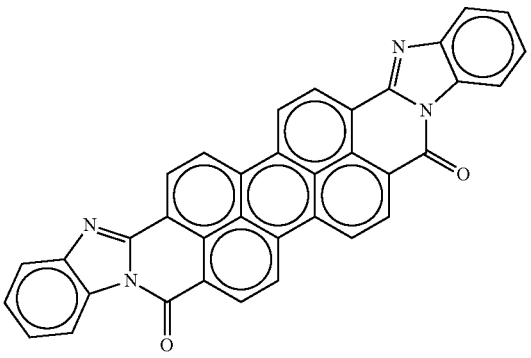

, and

II

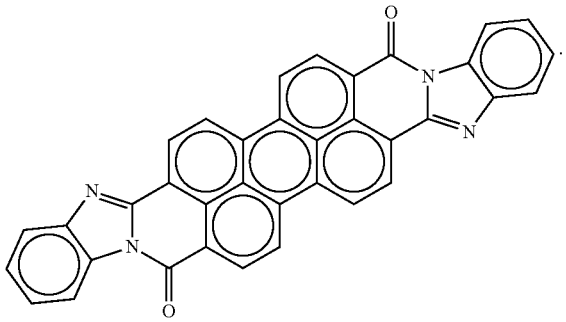

As shown in FIG. 1, a printed ink layer containing 7.5% pigment loading by weight of LUMOGEN® Black FK4280 was reported by the manufacturer, BASF, to produce a percent transmission of about 10% or less over the range of 300 nm to about 700 nm, and a percent transmission of 80-90% over the range of about 800 nm to about 1300 nm. LUMOGEN® BLACK 4281 reports a percent transmission of about 10% or less up to about 900 nm and a percent transmission of about 80-90% over the range of about 1100 nm to about 1300 nm. Accordingly, it is contemplated herein that the IR transmissive black colorants that may be employed in a given toner formulation herein may include those IR transmissive colorants that transmit 10% or less over the range of about 300-700 nm but which transmit 80% or more of incident light at wavelengths over 800 nm, and more specifically, transmit 80% or more of incident light over the wavelength range of 800-1300 nm, including all values and increments therein. By contrast, carbon black may be seen to absorb substantially all light over the wavelength of 400-1300 nm.

Another exemplary black infrared transmissive pigment that may be used herein includes BASF PALIOGEN Black S 084, which is a functionalized perylene pigment of the following structure:

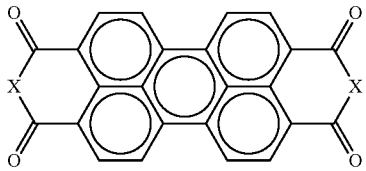

wherein the hue of the pigment may be varied by the nature of the subgroup "X" in the above formula. For example, X may be oxygen, an imide or a substituted imide (N—R) where R may be an alkyl group, a hydroxyl-alkyl group, an aromatic group, a substituted aromatic group, such as the following:

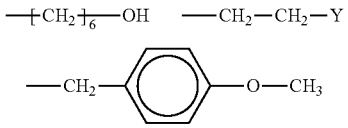

wherein Y itself may be a phenyl group, methyl group or hydroxymethyl group. In addition, one form of a black perylene pigment applies in the specific case where X═N—$CH_2CH_2Ph$. Such pigment also is known as C.I. Pigment Black 31.

Another exemplary black IR transmissive pigment may include azomethine black. An exemplary azomethine black may have the following structure:

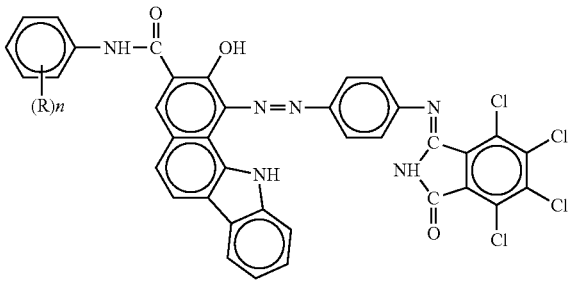

wherein R represents a group selected from the group consisting of alkyl groups having 1 to 3 carbon atoms and alkoxy groups having 1 to 3 carbon atoms, n may be an integer from 1-5, and when n is at least 2, Rs may be the same or different.

Yet another IR transmissive pigment may include aniline black, which may be understood as a black dye based upon aniline ($C_6H_5NH_2$). A commercial form of aniline black is available as BS-890 from Degussa Corporation. Aniline black may have the formula $(CH_3)_2NC_6H_4N{=}NC_6H_4NH_2$ which may then indicate the following structure:

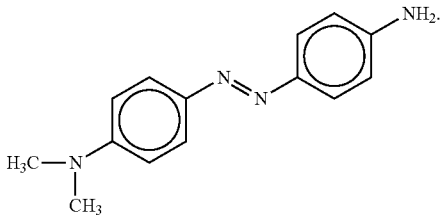

The IR transmissive black pigments herein that may be formulated in the toner, along with the IR absorbing black pigment (e.g. carbon black), may also include combinations of IR transmissive colored pigments that when combined provide a black color (as noted above, a Chroma of less than 15.0). For example, the infrared transmissive pigments may include two or more of the following: blue pigment, cyan pigment, green pigment, yellow pigment, orange pigment, brown pigment, red pigment, magenta pigment, violet pigment. Accordingly, when such pigments are combined they may provide such black color. For example, the IR transmissive pigments may therefore specifically include phthalocyanine or carmine, such as carmine HF4C, and may be, for example, pigment blue 15:3 and pigment red 185 at approximately 1:2 proportions respectively. The IR transmissive pigments that may also be combined to provide a black color may include cyan and orange, cyan and red, cyan and brown, blue and yellow, blue and orange, blue and red, blue and brown, green and violet, and cyan, magenta and yellow. It should be noted that the inclusion of black pigments like carbon black in multi-pigment black mixtures may help to minimize any potential hue issues. These hue issues may arise because of scattering of light by the pigments and imperfect spectral balance of the color pigment combinations. In such regard it may be appreciated that the aforementioned pigments that may be utilized to combine and provide such black color may have the following spectral characteristics as noted in Table 1:

TABLE 1

| Pigment | Approximate Absorption Band Wavelengths (λ) (nm) | Pigment Examples |
|---|---|---|
| Blue | 510-700 | Pigment Blue 80<br>Pigment Blue 60 |
| Cyan | 550-700 | Pigment Blue 15:1<br>Pigment Blue 15:3 |
| Green | 400-450 & 580-700 | Pigment Green 7<br>Pigment Green 36 |
| Yellow | 400-500 | Pigment Yellow 74 |
| Orange | 400-550 | Pigment Orange 71 |

TABLE 1-continued

| Pigment | Approximate Absorption Band Wavelengths (λ) (nm) | Pigment Examples |
|---|---|---|
| Red | 400-580 | Pigment Orange 43<br>Pigment Red 144<br>Pigment Red 264 |
| Magenta | 500-580 | Pigment Red 122<br>Pigment Red 185 |
| Violet | 500-600 | Pigment Violet 29<br>Pigment Violet 19 |
| Brown | 400-580 | Pigment Brown 25 |

A series of toners were therefore prepared utilizing the above described IR transmissive colorants (LUMOGEN Black 4280) with carbon black loadings at 0%, 1.0%, 2.0%, 3.0% and 4.0% by weight in a sample toner. These toners were then evaluated for toner patch sensor response utilizing direct illumination with indirect detection, as referenced above. At a carbon black loading of about 2.0% by weight or less, it was observed that an acceptable black toner was produced with acceptable toner patch sensitivity. Reference to the "about" herein may therefore be understood to include +/−0.10% by weight of the total toner composition. In particular, it was observed that toner patch sensitivity was acceptable in detecting toner at a target mass per unit area (M/A) of about 0.4-0.5 mg/cm$^2$ with 6 micron toner. Accordingly, it is contemplated herein that the target toner mass range that may be detected utilizing the above referenced black IR transmissive pigment(s), alone or in combination with an IR absorbing black pigment, may have a M/A value of about 0.1 to 1.5 mg/cm$^2$, including all values and increments therein.

In a broad aspect it may now be appreciated that a toner formulation capable of optimally responding to a toner patch sensor (TPS) may include at least one infrared transmissive pigment alone or in combination with an IR absorbing black pigment such as carbon black. The IR transmissive pigment itself may also: (1) itself be sourced from one or more IR transmissive black pigments (e.g. a perylene base structure, a functionalized perylene structure, and/or an azomethine compound) and/or (2) itself be obtained from a combination of color pigments which when combined provide a black color (Chroma less than or equal to 15.0); and/or (3) include a combination of IR transmissive black pigments and color pigments. The IR transmissive pigments may be present in a given toner formulation at levels of about 1-1.5% by weight, including all values and increments therein. Such compositions therefore may provide an acceptable black color as well as allowing for performance of a toner patch sensor for identifying a given unfused toner at a target M/A range of about 0.1 to 1.5 mg/cm$^2$.

In addition, the compositions herein may, in bulk powder, exhibit a reflectivity of greater than or equal to about 7.5% and less than or equal to 60% at a wavelength of about 940 nanometers, for toner particles having a diameter of about 5.5-10.0 microns. Bulk powder reflectivity may be understood herein as reflectivity at saturation (i.e. sufficient toner mass is present such that the effects of any underlying layer become irrelevant with respect to reflectivity at 900-1900 nm).

Figure 2:
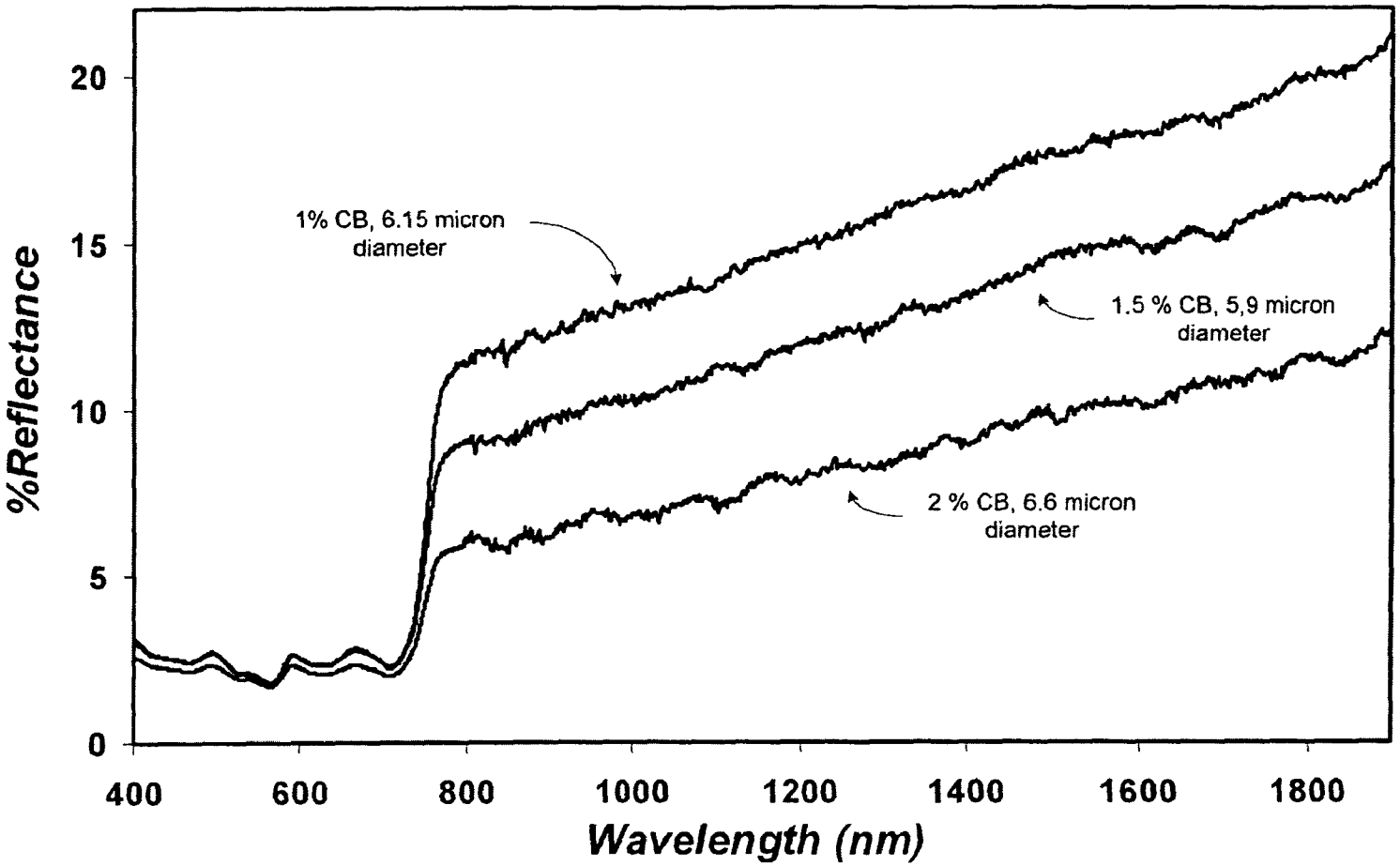
FIG. 2 is a plot of the bulk unfused toner reflectivity versus wavelength for black toner formulations, prepared as described herein.

FIG. 2 illustrates an example of a plot of bulk unfused toner reflectance versus wavelength (on a Cary 500 Spectrophotometer) for chemically processed toners having a mean diameter of about 5.9 to 6.6 microns. The carbon black loading for the formulations include 1%, 1.5% and 2% by weight of the toner. These compositions indicate a reflectance of less than 3% for 400 to 700 nm wavelengths. However, as can be seen, they indicate a reflectance of greater than at least 6% for 850 to 2,000 nm wavelengths.

In a further exemplary embodiment, the toner compositions may include, in addition to the infrared transmissive colorants described above, one or more infrared reflective colorants. In that context, reference is made herein to U.S. application Ser. No. 11/362,383 entitled "Image Forming Media Containing Reflective Pigments" whose teachings are incorporated herein in their entirety by reference. Infrared reflective colorants may therefore be understood as colorants which are capable of reflecting at least about 5% or more and up to 99%, including all values and increments therein, of the incident light in the infrared spectrum including wavelengths in the range of about 700 to 3,000 nm. Such colorants may also substantially absorb all light in the visible spectrum of about 400-700 nm (i.e. 90% or more of all light over the wavelengths of about 400-700 nm).

Such IR reflecting colorants may therefore include oxide complexes such as chromium (III) oxide, titanium oxide, titanium oxide including coatings of iron titanium oxide and other oxides. Such exemplary colorants may also be available from Shepherd Color, Cincinnati, Ohio under the trade name SHEPHERD BLACK 411, from Titan Kogyo, KK, Japan under the product number ETB-100 and from Ferro Corp., Cleveland, Ohio, under the product designation ECLIPSE 10201. The infrared reflective colorants may be present in the range of about 1 to 15% by weight of the toner composition, including all values and increments therein. Accordingly, the IR reflective colorants may include those pigments that provide different colors, as well as those that are effectively black.

By way of further example, a given toner composition herein may therefore include about 1-15% by weight of IR transmissive colorant and 1-15% of IR reflective colorant. For example, BASF LUMOGEN BLACK FK4280 which may be combined with a chromium III oxide pigment such as SHEPHERD BLACK 411 (C.I. Pigment brown 29) to provide a black toner with acceptable TPS sensitivity. Another contemplated combination includes BASF LUMOGEN BLACK FK4280 blended with ETB-100 which is commercially available from Titan Kogyo, K.K., Japan. ETB-100 is IR absorptive at 940 nm, so it could be used in place of carbon black to make a semi-absorptive black toner.

Figure 3:
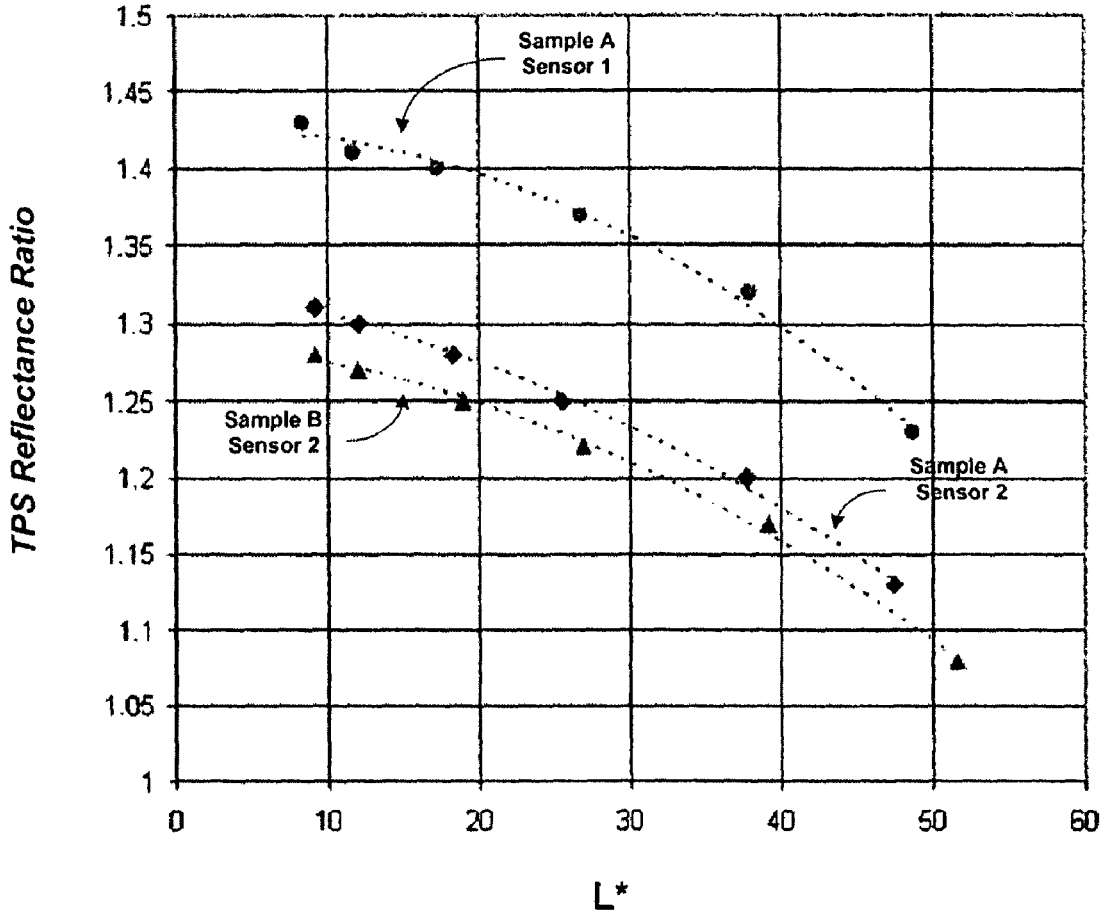
FIG. 3 is a plot of toner patch sensor (TPS) reflectance ratios versus L* for exemplary toners.

It may now be noted that toner patch sensor measurements of unfused toner may be correlated with the print density (L*) of fused toner test patches, wherein an L* value of 0 represents an ideal black patch with no first surface reflection and an L* of 100 represents an ideal white surface. Such a correlation is illustrated in FIG. 3, which is a graph of toner patch sensor reflectance ratios of exemplary toner formulations with respect to the L* of the fused test patches printed on Hammermill Laser Print paper. The reflectance ratio in this example is the ratio of the TPS signal for the unfused toner test patches to the TPS signal for the bare intermediate belt surface.

More specifically, referring back to FIG. 3, two exemplary toner sample combinations "A" and "B" were utilized in the exemplary predictive model. These compositions are merely examples of the many compositions which may be formulated from the description above and are not meant to be limiting herein. Sample "A" includes 2% by weight of the toner composition carbon black in combination with 8% by weight of the toner composition LUMOGEN BLACK FK4820 (IR transmissive colorant). Sample "B" includes 2% by weight of the toner composition carbon black in combination with 8% by weight of the toner composition LUMOGEN BLACK FK4820 (IR transmissive colorant) and 4% by weight of an infrared reflective dispersion 50-990-20957R containing a Cr III compound available from Plasticolors. While FIG. 3 shows improved signal slopes in the 5-15 L* range compared to conventional black toners with 6-8% carbon black by weight, it should be noted that the two sensors produced markedly different signal correlations with L* for the same toner (Sample A). It should be noted that toner patch sensor reflection ratios are sensitive to variations in the sensor construction and their positioning relative to the intermediate belt, as well as to changes in the reflectivity of the intermediate belt. If these sources of error can be adequately controlled, the improved TPS signal slope of such toners can provide acceptable accuracy of solid area density control.

Accordingly, it should be appreciated that various toner compositions and intermediate transfer belts may provide different reflective ratio plots having different slopes. Furthermore, the data may be otherwise interpolated and/or extrapolated using predictive formulas derived from measured data points. In addition, it may be appreciated that tolerances may be set for the values such that the process may be adjusted depending on whether the reflective ratio is within a given tolerance.

In addition, toner patch sensor measurements of the toner compositions described herein may be used in combination with an improved toner patch sensor algorithm. Such algorithm is described in U.S. patent application Ser. No. 11/771,121, filed on Jun. 29, 2007, the subject matter of which is incorporated by reference herein. In general terms, the toner patch algorithm may be utilized to nominalize the toner patch sensor measurements, wherein toner patch measurements may include toner patches of the toner compositions described herein, toner patches of the toner compositions described herein on a control surface, such as an intermediate transfer belt, toner patches of the toner compositions described herein disposed over toner patches of either magenta, cyan or yellow toner and measurements of the magenta, cyan or yellow toner, and the bare control surface. Utilizing the TPS signals one may determine a reflective ratio (RR) being the reflectivity of a given toner as compared to the reflectivity of the belt.

Figure 4:
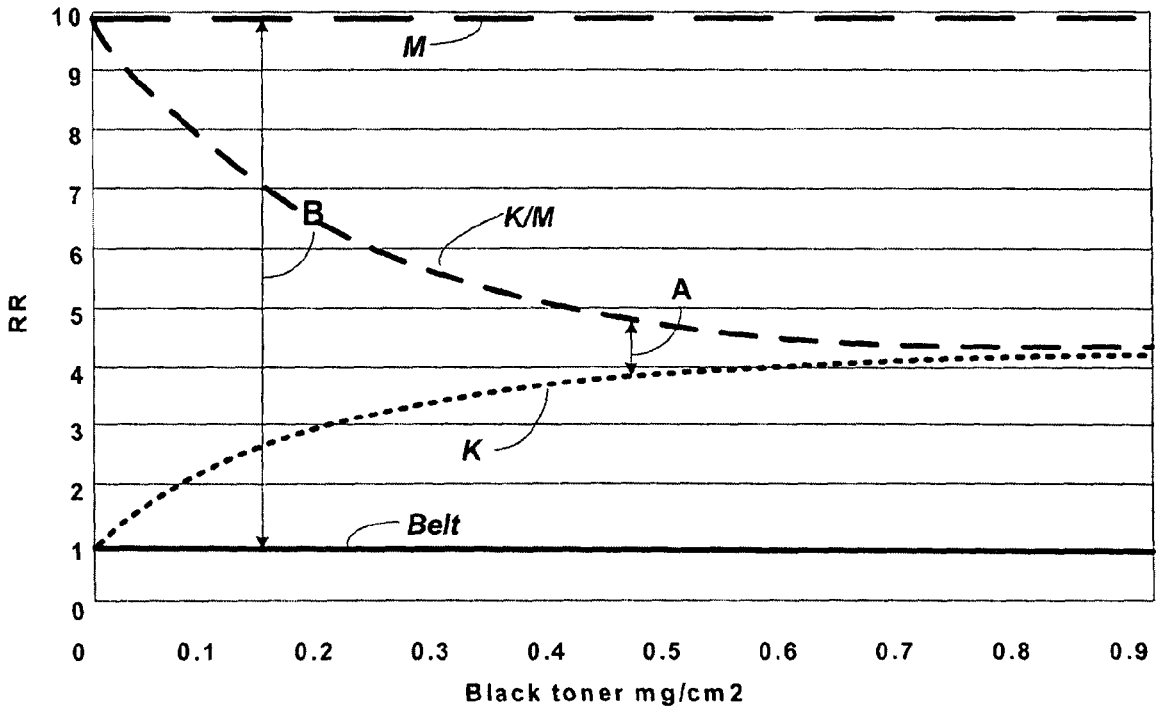
FIG. 4 is a plot of the TPS reflectivity versus toner density for an exemplary black toner prepared with the IR transmissive pigments described herein, printed over a magenta toner layer and over a bare intermediate belt surface.

An exemplary illustration of such measurements is illustrated in FIG. 4. As can be seen in the figure, the reflectivity ratio (RR) of the black toner composition "K," prepared including the black transmissive pigment(s) described herein, may be greater than the belt "Belt", particularly as the toner approaches saturation, i.e., higher printed toner densities (m/a). The magenta toner "M" is printed in patches at the same density and therefore the measured reflectivity ratio remains relatively constant for the magenta toner. In addition, the measured reflectivity ratio of the patches including black of a given density printed over the magenta at the constant density "KIM", decreases as the printed black toner density increases.

Multiple test patches of the black and black over magenta (or yellow or cyan) toner may be printed and at least one or more test patches of the magenta toner may be printed. The patches may then be measured using a toner patch sensor, wherein, as described above, incident light is measured by an optical element, providing a voltage. The measurements or signals indicative of the reflectivity may then be correlated utilizing the following formula to return a calculated Ratio (A:B) to compare to a predetermined Ratio (A:B), wherein $$\text{Ratio}(A:B) = \frac{R_{K/M} - R_K}{R_M - R_{belt}}$$

and $R_{K/M}$ may be a signal indicative of the reflectivity of the black over magenta toner patch, $R_K$ may be a signal indicative of the reflectivity of the black toner patch, $R_M$ may be a signal indicative of the reflectivity of the magenta toner patch, $R_{belt}$ may be a signal indicative of the reflectivity of the belt and $R_M \neq R_{belt}$. Ratio (A:B) (calculated or predetermined) may range from 0 to 1, wherein 1 may indicate that little to no absorptive or black toner has been deposited. A value approaching zero may indicate that the absorptive toner may be nearly saturated. The predetermined Ratio (A:B) may be a given number provided based on the desired L* value, the bulk reflectivity of the toner, or combinations thereof. The bulk reflectivity of the toner may be understood as a saturated reflectivity, such that the effects of an underlying surface are not detected or negated by the toner.

Figure 5:
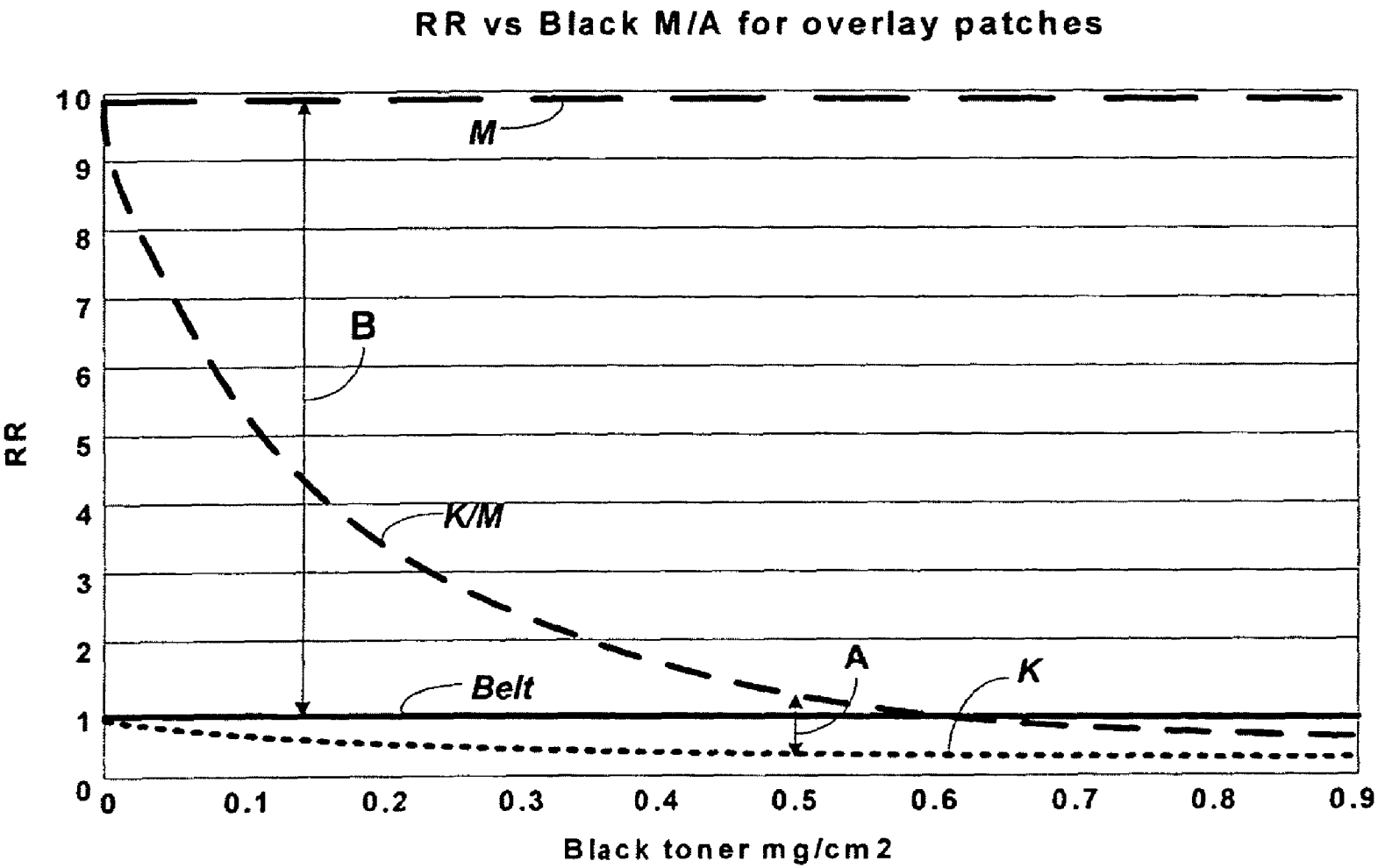
FIG. 5 is a plot of the TPS reflectivity versus toner density for black toner, prepared without the IR transmissive pigments described herein, printed over a magenta toner layer and over a bare intermediate belt surface.

In utilizing a toner formulation that may not include pigments with low infrared absorption at the TPS wavelength, as illustrated in FIG. 5, the reflectivity ratio of a given black toner composition "K" may be less than the control surface or intermediate belt "Belt" in the image forming device. Such formulations may provide a smaller change in reflectivity with changes in toner density (mass/area) as compared to the toner compositions described herein, see again FIG. 4. These more IR absorptive formulations may produce/require target ratios (A:B) which are 3-6 times smaller than the preferred low infra-red absorptive black toners.

Figure 6:
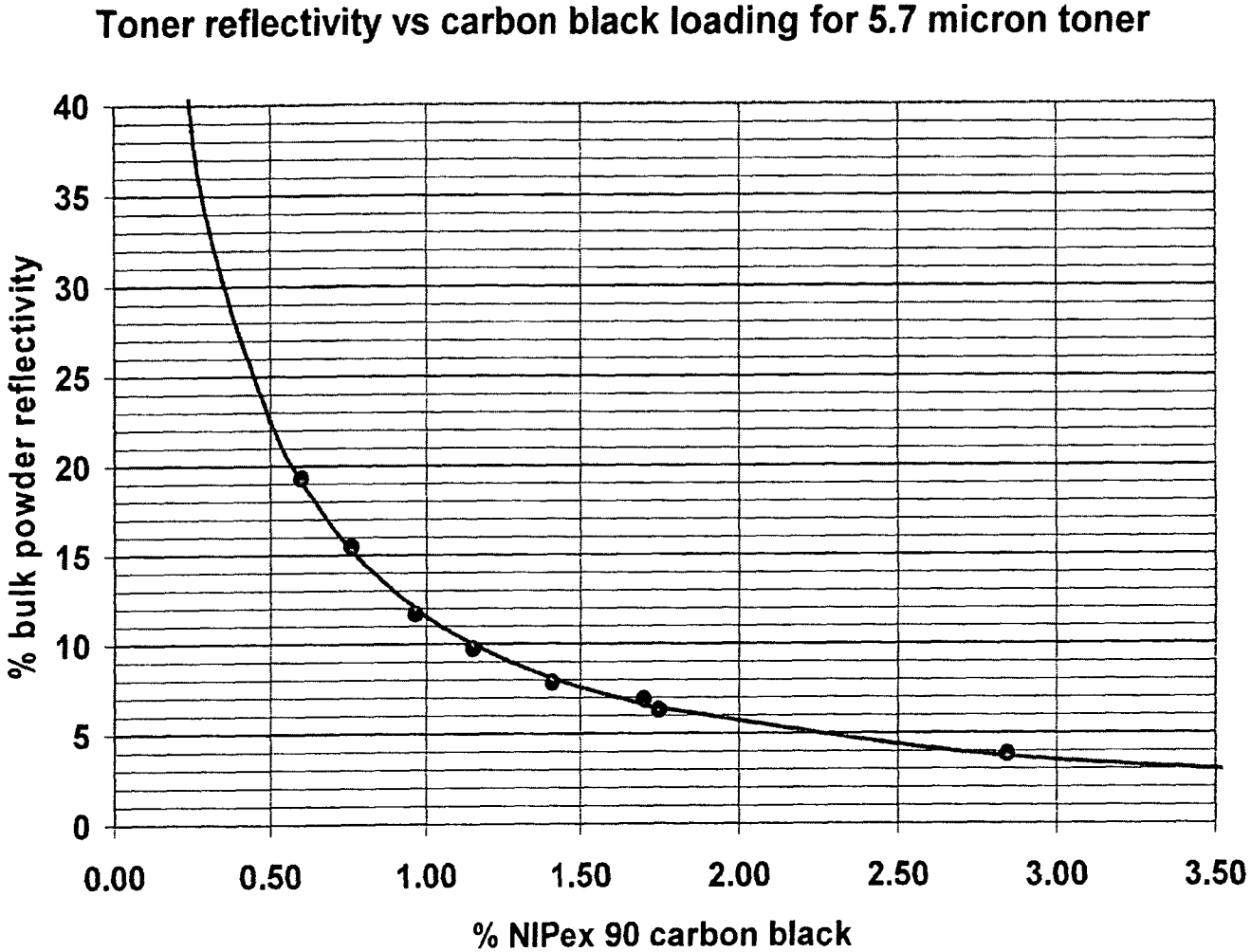
FIG. 6 is a plot of toner reflectivity vs. carbon black loading for 5.7 micron toner at 940 nm.

To correctly render images, the printer may need to lay down the proper amount of toner not just for regions with 100% coverage, but for all halftone shade levels. To enable the TPS to properly monitor the printing of black halftone TPS test patterns, the black toner may need to exhibit adequate reflective contrast relative to the intermediate belt. FIG. 6 shows how the toner powder reflectivity at 940 nm varies with carbon black loading for toner particles approximately 5.7 microns in diameter. While reducing the carbon black loading to 2.5% may provide improved accuracy for monitoring and setting the black solid area mass per unit area, such a black toner would exhibit a bulk powder reflectivity of approximately 4.5%. This unfused toner reflectivity would produce a very low reflectivity contrast between the halftone dots and intermediate belts which are loaded with carbon black to make them conductive. Such belts typically exhibit a reflectivity of 4-6%. Such a low contrast may make it very difficult to detect whether or not low area coverage halftone patterns, like a 6% halftone test pattern for example, are being printed with the correct amount of toner or not. If the TPS cannot accurately monitor low area coverage halftones, then the TPS cannot provide the printer with all the information needed to properly render the halftone printing curve and objectionable image artifacts may occur. The optimum toner powder reflectivity for setting the solid area density is approximately midway between the color toner reflectivity, which is typically near 30%, and the belt reflectivity, which is typically near 4%. Thus a toner powder reflectivity of approximately 15-20% would provide both good accuracy for solid area density control and good contrast between the black halftone dots and the intermediate belt. Carbon black loadings between 0.5-1.0% appear to be optimal for maximizing the TPS accuracy for both solid area and halftones for black toners with particles sizes of about 6 microns.

Figure 7:
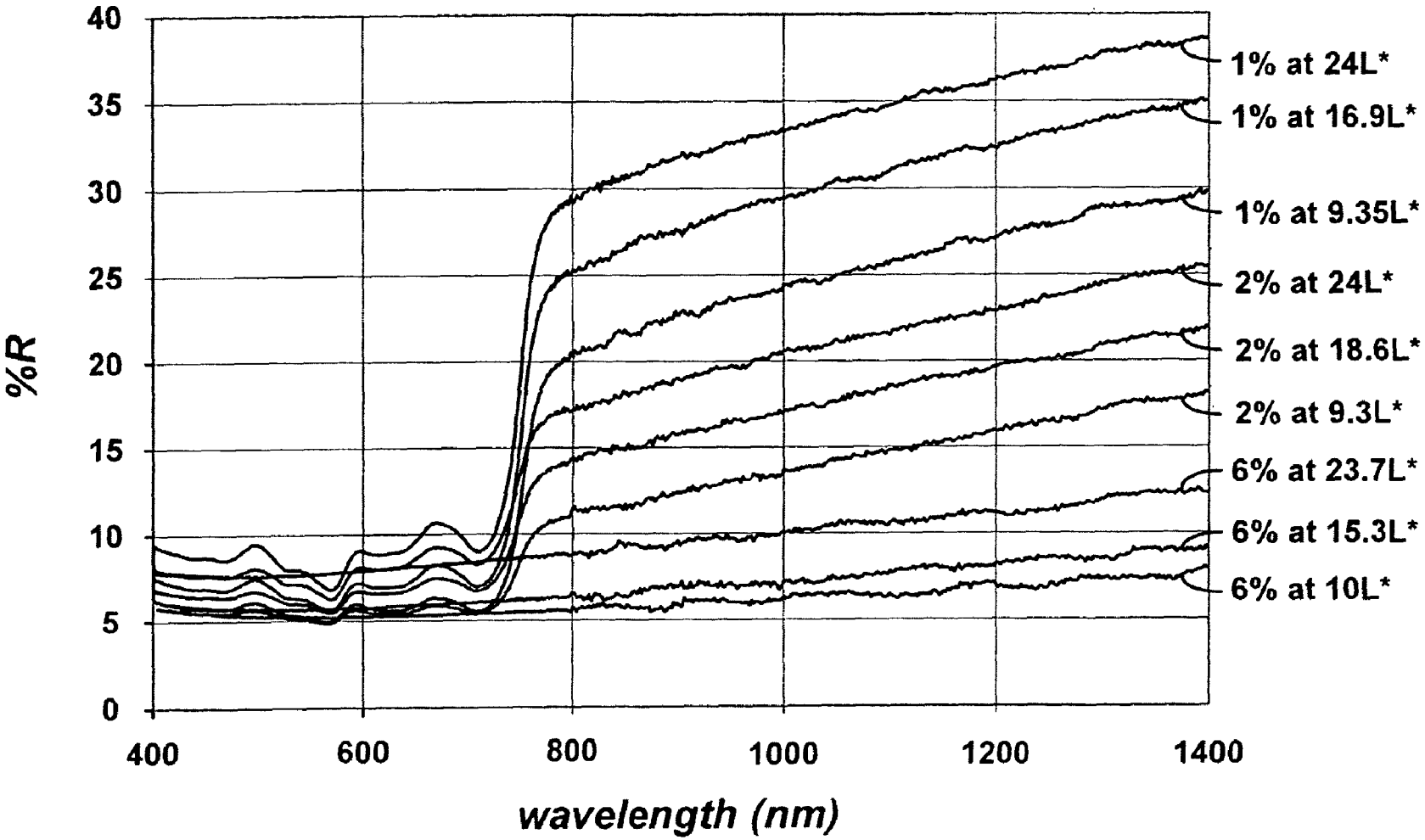
FIG. 7 shows reflectance spectra for fused toner patches printed on Hammermill Laser Print 24 lb paper.

Exemplary black toner formulations which employ mixtures of absorptive and transmissive pigments exhibit markedly higher reflectivities above 800 nm compared to the visible range, 400-700 nm. This characteristic has been found to be true not only for unfused toner powder, but also for fused toner layers on paper. FIG. 7 shows reflectance spectra for fused toner patches printed on Hammermill Laser Print 24 lb. paper. These patches were printed with three different toners and at three different darkness settings. The carbon black loading of each toner and the measured L* values for each test patch are shown for each spectrum. The toner with 6% carbon black loading by weight had no other pigments besides carbon black. The other two toners were comprised of mixtures of pigment blue 15:3, pigment red 185, and pigment yellow 74 with their respective carbon black loading. The reflectance spectra were obtained using a Cary 500 Spectrophotometer with the samples illuminated at near normal incidence. Although the spectrophotometer was configured to exclude specularly reflected light, the surface texture of the fused toner patches was such that only a small fraction of the first surface reflection escaped capture by the integrating sphere of the spectrophotometer. As with the bulk unfused toner powder spectra, the reflectance values for wavelengths above about 800 nm show a marked increase as the carbon black loading is decreased.

Figure 8:
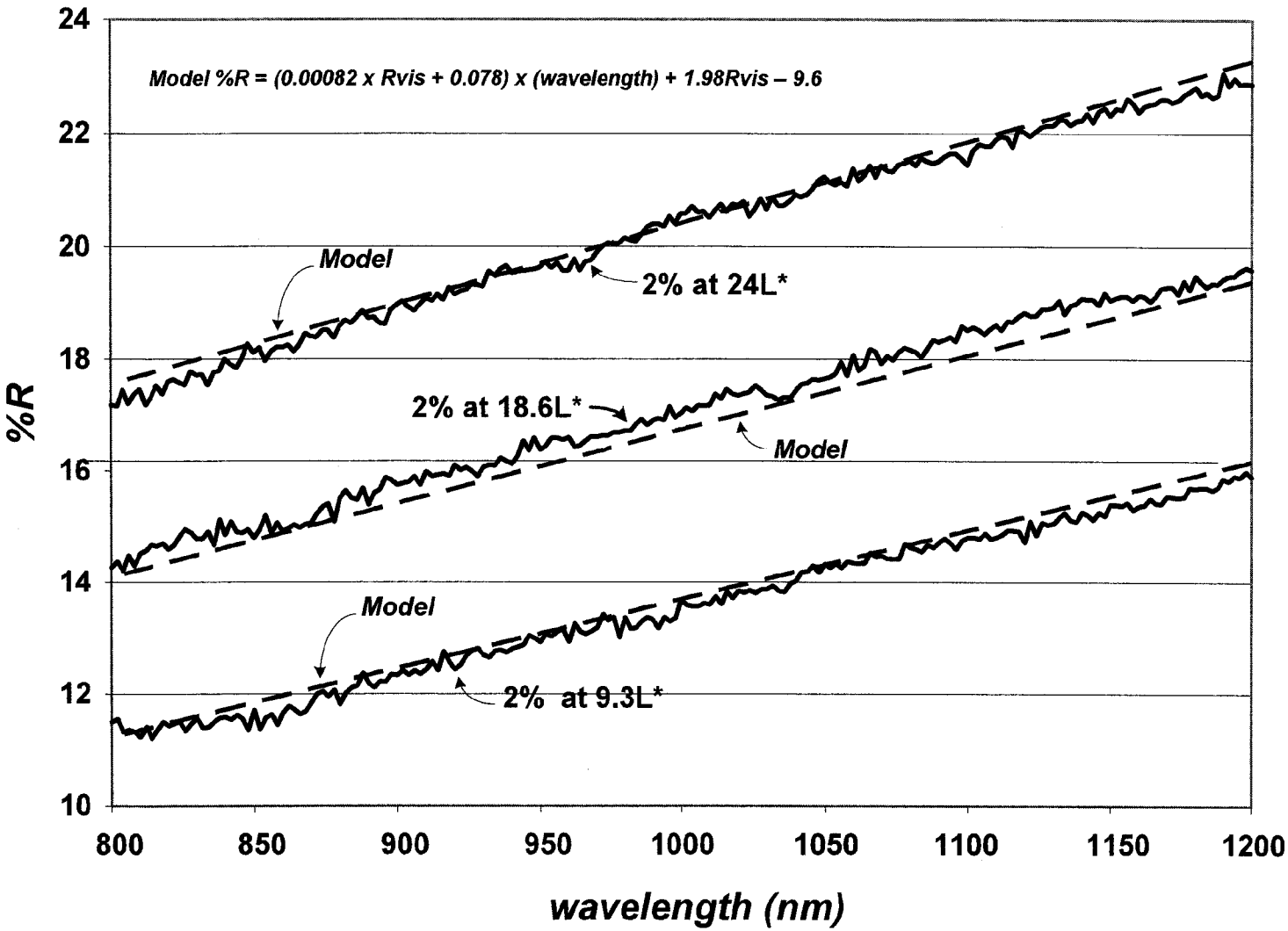
FIG. 8 is an exemplary embodiment of an image forming device containing a processor and a storage device therein.
Figure 9:
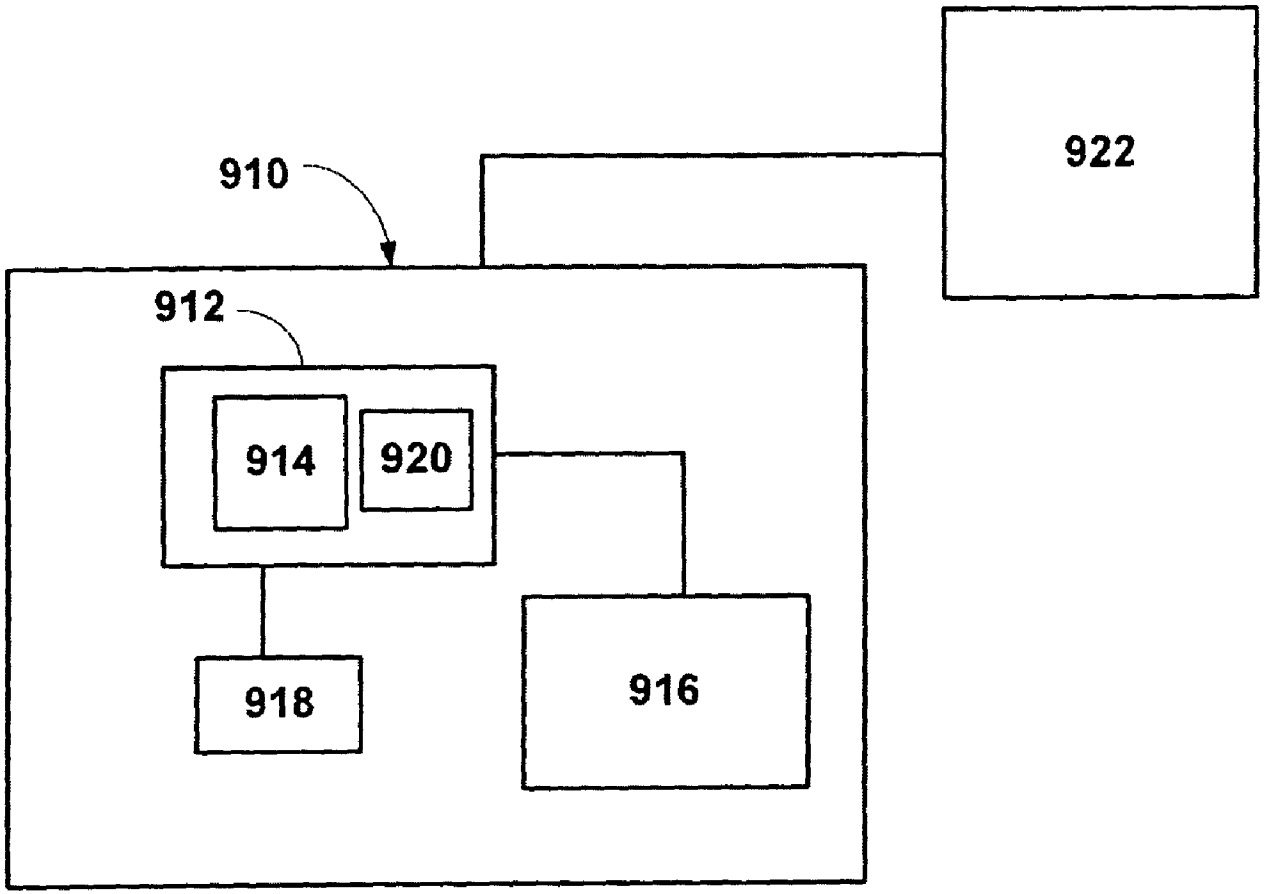

In an exemplary embodiment, the algorithm analysis performed herein may be accomplished by, as illustrated in FIG. 8, a processor 812 found in a controller 814 of the image forming device 810. The controller 814 may communicate with and receive signals/data from the storage devices on the cartridge 816 and the toner patch sensor 818. The data received may be referenced to a series of lookup tables provided in memory 820 located in the image forming device, a toner cartridge 816 for use with the image forming device or in a computer 822 which may be in communication with the image forming device. The analysis provided herein in combination with the given toner formulations may therefore be utilized to adjust an operating parameter of the image forming device, such as photoconductor or developer roll bias, etc., based on the a comparison of the calculated Ratio to the predetermined Ratio (A:B).

It should now also be clear that embodiments of the methods described above may be implemented in a computer program that may be stored on a storage medium having instructions to program a system to perform the methods. The storage medium may include, but is not limited to, any type of disk including floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, magnetic or optical cards, or any type of media suitable for storing electronic instructions. Other embodiments may be implemented as software modules executed by a programmable control device.

Thus, as may be understood from the above, an aspect of the present disclosure relates to the use of the toner formulations described herein in image forming devices that may include toner patch sensors. In addition, a method is provided for adjusting printing parameters based upon the use of a toner patch sensor in combination with the toner formulations above. Furthermore, a method is provided for determining a correlation between reflectance ratios between printed toner and a control (such as an intermediate belt), which may be utilized in process adjustment in an image forming device.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A toner formulation comprising:

a binder;

an infrared absorbing black pigment at a concentration of 0.25-2.0% by weight; and a plurality of infrared transmissive pigments other than a black pigment, wherein said plurality of infrared transmissive pigments are configured to provide a black color.

2. The toner formulation of claim 1 wherein said plurality of infrared transmissive pigments configured to provide a black color comprise two or more of the following: blue pigment, cyan pigment, green pigment, yellow pigment, orange pigment, brown pigment, red pigment, magenta pigment, and violet pigment.

3. The toner formulation of claim 1 wherein said black color comprises a color having a chroma C* of less than or equal to 15.0 for all half-tone shade levels printed on white paper.

4. The toner formulation of claim 2 wherein said blue pigment absorbs at a wavelength of 510-700 nm, said cyan pigment absorbs at a wavelength of 550-700, said green pigment absorbs at a wavelength of 400-450 nm and 580-700 nm, said yellow pigment absorbs at a wavelength of 400-500 nm, said orange pigment absorbs at a wavelength of 400-550, said brown pigment absorbs at a wavelength of 400-580 nm, said red pigment absorbs at a wavelength of 400-580 nm, said magenta pigment absorbs at a wavelength of 500-580 nm, and said violet pigment absorbs at a wavelength of 500-600 nm.

5. The toner formulation according to claim 1 wherein said plurality of infrared transmissive pigments comprise one of the following color combinations:

(a) cyan and orange;

(b) cyan and red; and (c) blue and red.

6. The toner formulation of claim 1 wherein said plurality of infrared transmissive pigments is present at a level of less than or equal to 15.0% by weight.

7. The toner formulation of claim 1 wherein said formulation exhibits a bulk reflectivity at about 940 nanometers, for toner particle sizes of 5.5 to 10 microns, of greater than 7.5% and less than or equal to 60%.

8. The toner formulation of claim 1 wherein said infrared absorbing black pigment comprises a pigment selected from the group consisting of carbon black, oxidic black pigment, iron oxide ($Fe_3O_4$), spinel black [$Cu(Cr,Fe)_2)O_4$], organic black colorants and mixtures thereof.

9. The toner formulation of claim 1 wherein said formulation is contained in an image forming apparatus.

10. The toner formulation of claim 1 wherein said formulation is contained in a printer cartridge.

11. A toner formulation comprising:

a binder;

an infrared absorbing carbon black at a concentration of 0.25-2.0% by weight; and a plurality of infrared transmissive pigments other than a black pigment at a level of less than or equal to 15.0% by weight, wherein said plurality of infrared transmissive pigments are configured to provide a black color and respond to a toner patch sensor to indicate a mass per unit area of unfused toner of 0.1-1.5 mg/cm$^2$.

12. The toner formulation of claim 11 wherein said formulation exhibits a bulk reflectivity of greater than 6.0% for a portion the wavelength range 850-2000 nm.

13. The toner formulation of claim 11 wherein said formulation is contained in an image forming apparatus.

14. The toner formulation of claim 11 wherein said formulation is contained in a printer cartridge.

15. A method for calibrating an image forming device using a toner patch sensor and a toner formulation comprising:

depositing a plurality of toner patches onto a control surface, wherein said toner patches include a first toner patch, including a first toner, a second toner patch including said first toner deposited over a second toner and a third toner patch including said second toner, wherein said first toner comprises a binder and an IR absorbing black pigment at a concentration of 0.25-2.0% by weight, including one or more infrared transmissive pigments, wherein said infrared transmissive pigments are configured to provide a black color;

measuring signals indicative of reflectivity of said plurality of toner patches and the reflectivity of said control surface by emitting light of a given wavelength in the infrared spectrum and detecting the amount of incident light reflected from said plurality of toner patches and said control surface; wherein said first toner patch exhibits a first reflectivity $R_1$ at said given wavelength, said second toner patch exhibits a second reflectivity $R_2$ at said given wavelength, said third toner patch exhibits a third reflectivity $R_3$ at said given wavelength, said control surface exhibits a fourth reflectivity $R_{control}$ at said given wavelength, wherein $R_{control} \neq R_3$; and adjusting an operating parameter based upon said measurements.

16. The method of claim 15 further comprising determining a ratio (Ratio (A:B)) according to the following relationship:

$$\frac{R_2 - R_1}{R_3 - R_{control}} = \text{Ratio}(A:B).$$

and adjusting an operating parameter of said image forming device based on said ratio.

17. The method of claim 16 wherein said toner formulation is capable of responding to a toner patch sensor to indicate a mass per unit area of toner of about 0.1-1.5 g/cm$^2$.

18. The toner formulation according to claim 1 wherein said plurality of infrared transmissive pigments comprises pigment blue 15:3 and pigment red 185 at a ratio of about 1:2.

* * * * *